US006222567B1

(12) United States Patent
Schuster et al.

(10) Patent No.: US 6,222,567 B1
(45) Date of Patent: Apr. 24, 2001

(54) METHOD AND APPARATUS FOR PRODUCING A THERMAL TRANSFER PRINT BY MEANS OF TAPE-LIKE TRANSFER FILMS

(75) Inventors: Alfons Schuster, Augsburg; Armin Weichmann, Kissing; Bernhard Feller, Friedberg; Dirk Probian, Gablingen/Lüzelburg; Michael Müller, Augsburg; Thomas Hartmann, Friedberg, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/268,003

(22) Filed: Mar. 15, 1999

(30) Foreign Application Priority Data

Mar. 13, 1998 (DE) ..... 198 11 029

(51) Int. Cl.[7] ..... B41J 2/32
(52) U.S. Cl. ..... 347/171
(58) Field of Search ..... 347/171, 224

(56) References Cited

U.S. PATENT DOCUMENTS 5,045,865 * 9/1991 Crystal et al. ..... 347/114
5,129,321 7/1992 Fadner .

FOREIGN PATENT DOCUMENTS 38 37 978 5/1990 (DE) .
44 30 555 4/1996 (DE) .
63-125534 8/1988 (JP) .

* cited by examiner

*Primary Examiner*—N. Le
*Assistant Examiner*—K. Feggins
(74) *Attorney, Agent, or Firm*—Cohen, Pontani, Lieberman & Pavane

(57) ABSTRACT

A method of producing a thermal transfer print on a substrate cylinder using a tape-like transfer film, the method including exerting a contact force on a substrate using the transfer film for producing a static friction force, and controlling exact synchronism between the tape-like transfer film and the substrate cylinder by using the magnitude of the static friction force.

7 Claims, 5 Drawing Sheets

METHOD AND APPARATUS FOR PRODUCING A THERMAL TRANSFER PRINT BY MEANS OF TAPE-LIKE TRANSFER FILMS

BACKGROUND OF THE INVENTION

1. Field of the Invention

The invention relates to the production of prints, especially multicolor prints or offset printing forms, by means of thermal transfer, using a narrow tape as a transfer film. More particularly, the invention relates to a method and apparatus for optimizing the imaging quality of a thermal transfer print of this type.

2. Discussion of the Prior Art

The thermal transfer method has been known in principle for a long time. A substrate, which may be the final substrate or an intermediate carrier, is brought into contact with a colored layer which is applied to a carrier and transfers this colored layer to the substrate, dot by dot and in accordance with an image, by means of the action of heat.

By means of different-colored films, a number of colors can also be applied one after another, and a colored print can thus be produced. If the substrate is an intermediate carrier, the finished multicolor image is then transferred to the target substrate in a further step. Furthermore, a printing form can also be coated in accordance with an image by means of a suitable polymer. If, for example, the base of the printing form is hydrophilic and hence does not accept ink, the image-carrying parts are transferred to this printing form by thermal transfer as a positive and are then hydrophobic, that is to say they accept ink.

Coating a substrate in this way, in particular by means of a laser, is disclosed by German reference DE 44 30 555 C1. This document describes a method and an apparatus by means of which a printing form can be produced simply and in a manner which can be integrated into the printing machine, in particular on a seamless printing-form cylinder with a smooth surface, without the gases which arc produced during the laser imaging operation noticeably interfering with the transfer of material from the thermal transfer film, that is to say the imaging quality.

Here, a tape-like transfer film with a tape width which is only a fraction of the substrate width is guided through between the substrate and the imaging unit, in the immediate vicinity of the substrate surface, by means of the tape transport mechanism. The tape transport mechanism, together with the imaging unit and electronically or mechanically coupled, is fitted to a traversing unit, so that the transfer film can be moved over the substrate width uniformly with the movement of the imaging unit. Together with the laser-induced thermal imaging unit, which is controlled in a known way by means of a control unit in accordance with an image to be transferred and, for each image point, introduces heat into the thermal transfer film, and thus performs a dot-by-dot transfer of the ink-accepting coating of the transfer tape, it is thus possible for the complete substrate, in particular the complete seamless printing-form cylinder, to be imaged all round.

It has transpired that transferring the thermal transfer material in the laser-induced thermal transfer process gives particularly good imaging results as a result of the transfer film rolling synchronously on the cylindrical substrate surface. This can be attributed in particular to the distance between the transfer tape and substrate then being a minimum.

As a result of this small distance, a low relative speed close to zero between the transfer film and the substrate surface leads to adhesion of the transfer tape to the substrate.

This is desirable, but necessitates truly exact synchronization, since any slight relative speed which may occur leads to "smearing" of the thermal transfer material on the substrate surface. The laser-induced thermal transfer process leads to the transfer film adhering temporarily to the substrate. If, in the event of a positive relative speed, the force causing the tape to advance is greater than the adhesion, then the bond will be broken and the transfer material will be transferred only to a partial extent and with smearing. As a result of the inherent elasticity of the transfer tape, adhesion alternates with sliding; the so-called "stick—slip" effect occurs: it is therefore essential for the speed of the transfer film and substrate surface to be exactly the same.

SUMMARY OF THE INVENTION

According to the invention, this object, of achieving a defined and minimum distance between the transfer tape and substrate, is achieved by using the transfer film to exert a contact force which acts on the substrate so as to produce a static friction force. The magnitude of the static friction force is used to control exact synchronism between the tape-like transfer film and the substrate cylinder.

The nub of the method is that a contact force is produced in a suitable way. This force produces a static friction force, which is used to control exact synchronism.

Furthermore, the contact force leads to the distance between the transfer film and substrate being minimized, in particular to the gases which occur as a result of the thermal transfer and the air which is dragged in between the transfer tape and substrate as a result of dynamic and boundary-layer effects being compressed or led away.

This control process is preferably carried out actively, but can also be carried out passively.

Active control is based on the effect that when there is exact synchronism, that is to say when there is no relative speed between the passage speed of the transfer film and the surface speed of the substrate, the tensile force that has to be applied by the rewinding drive in order to wind the thermal transfer tape around once the latter has been accelerated is minimal. This minimal tensile force will be referred to below as the synchronous winding force. The synchronous winding force is essentially determined by the frictional force which has to be overcome in order to deflect the tape being guided, the force required to tear the transfer tape off the substrate surface during a thermal transfer (the thermal transfer leads to the transfer film "sticking" at the point of laser influence), the force components, which are brought about by contact pressure measures, in the direction of movement of the tape when it is running synchronously, for example as a result of the tape being blown on obliquely, and the opposing force needed by the unwinding drive in order to apply tape tension.

As an alternative embodiment, control may also be carried out passively, by a defined speed, which differs only very little from the circumferential speed of the substrate, being predefined and the differential speed being compensated for via the plastic expansion of the transfer tape. However, this necessitates the static friction force being greater than the force needed for plastic expansion of the transfer tape.

For all types of control, the contact force for producing the static friction force is produced on the one hand by the tape tension in conjunction with the thermal transfer tape wrapping around the substrate cylinder, and on the other hand by further force components which press the tape against the substrate cylinder. These force components are preferably produced by air being blown on. Developments make use of electrostatic forces by applying charge to the rear of the tape, or a vacuum which is produced by extracting the air in the entry gap, that is to say at the location where the transfer tape and substrate surface run together.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

The method of driving, the construction and the method of operation of a printing head which emits one or more laser beams arc known per se to those in the art and therefore do not require any more specific explanation in the present connection.

Figure 1:
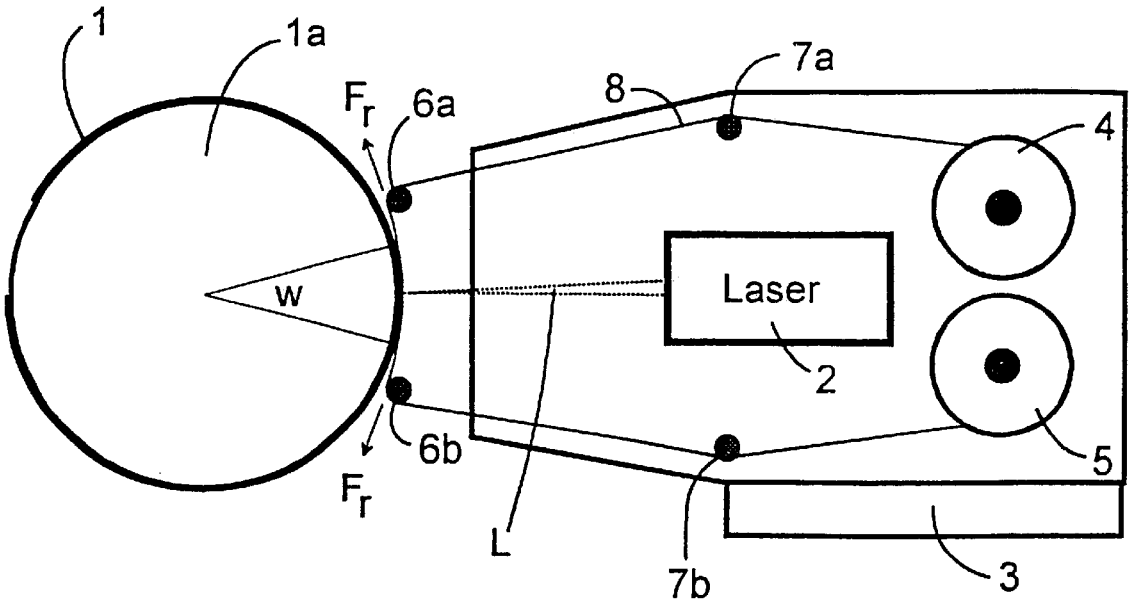
FIG. 1 shows a schematic side view of a thermal transfer apparatus for implementing the method according to the invention, with a first tape guiding means.
Figure 2:
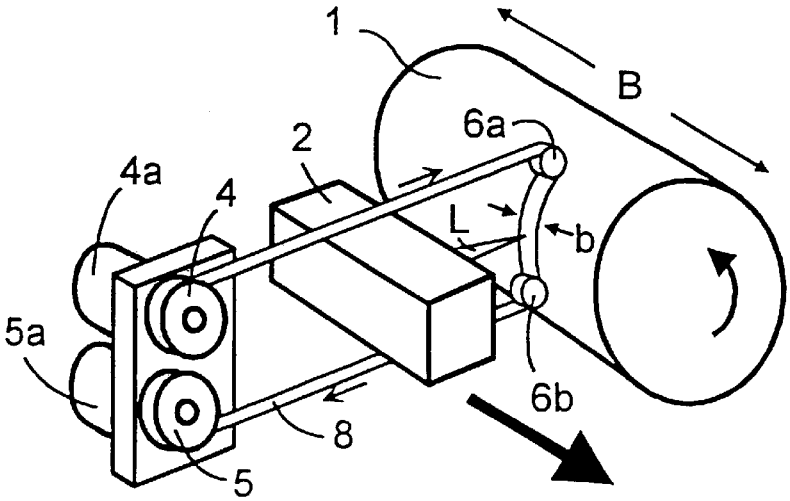
FIG. 2 shows a perspective view of the arrangement of FIG. 1 with visible drive motors.

FIG. 1 and FIG. 2 show a substrate cylinder 1, to whose surface a substrate la has been applied. A tape transport mechanism, comprising a supply roll 4 and a rewind roll 5 (the identification of the supply roll 4 and of the rewind roll 5 is merely representative of one running direction of the tape-like thermal transfer film 8, in the opposite direction they would of course have to be the supply roll 5 and rewind roll 4) with the associated drives 4*a*, 5*a*, two contact rolls 6*a*, 6*b* and two guide rolls 7*a*, 7*b*, leads a tape-like thermal transfer film 8, referred to below as a transfer tape, close to the substrate cylinder 1 or in contact with the substrate 1*a*. A laser writing head 2 focuses one or more beams onto the transfer tape 8. In the preferred arrangement, the laser writing head 2 and the tape guide mechanism 4, 4*a*, 5, 5*a*, 6, 7 are jointly arranged on the traversing unit 3, by means of which they can be moved over the width B of the substrate cylinder 1.

Figure 3:
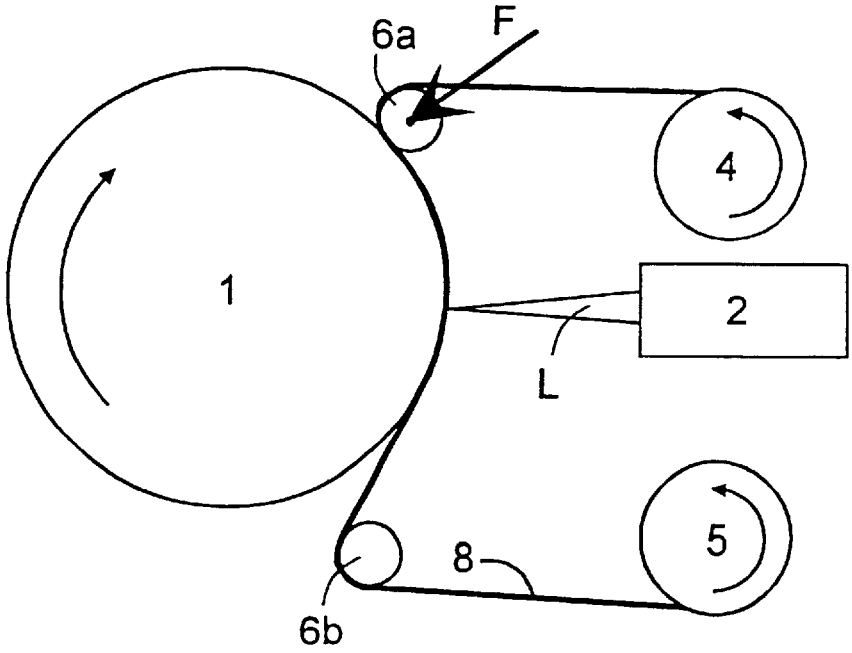
FIG. 3 shows a side view of a thermal transfer apparatus for implementing the method according to the invention, with a second tape guiding means.

During the imaging operation, the transfer tape 8 is brought by means of the contact rolls 6*a*, 6*b* into contact with the surface 1*a* of the substrate cylinder 1, at a wrap angle which is small but sufficient to build up a contact force and hence a frictional force between the transfer tape 8 and the substrate 1*a*. The contact force is produced via the wrap angle in combination with the tension Fr under which the transfer tape 8 is kept. This tape tension Fr is produced by means of electronically controllable motors 4*a*, 5*a*, which drive the supply roll 4 and the rewind roll 5. Possible control algorithms are illustrated in FIGS. 5 to 8. The transport direction and the traversing movement are indicated in FIG. 3 by means of arrows. Obviously, the transfer film 8 can also be transported in the opposite direction. The tape tension Fr is preferably in the range of a few Newtons and is kept constant during the imaging operation.

In this arrangement, the speed of the transfer tape 8 is exactly equal to the surface speed of the substrate 1*a*. This exact agreement is necessary since if minimal speed differences nevertheless arise during synchronous running, the so-called stick—slip effect occurs, that is to say the contact between the transfer tape and substrate oscillates to and fro between the states of static (adhesive) friction and sliding friction. However, optimum transfer is possible only in the adhering (sticking) state.

The control process makes use precisely of the fact that, at an exactly synchronous speed, the transfer tape sticks to the substrate, and hence no force other than the synchronous winding force is needed to convey the tape. If a speed difference occurs, the static friction changes into sliding friction, whose magnitude is less, and the power needed to transport the tape differs from the synchronous winding force. The power needed can be determined, for example, via the current needed for the motors of the supply roll and the rewind roll.

This control requires a certain level of the frictional forces to allow differentiation between sticking and sliding. These frictional forces are brought about by the contact force that acts on the transfer tape, that is to say the force normal to the tape. The frictional force results from this contact force, the coefficient of friction between tape 8 and the substrate 1*a*, and the area over which the force acts.

In a preferred arrangement, the contact force is produced via the tape tension Fr in conjunction with a wrap angle w. The frictional force becomes greater, the greater the wrap angle, and hence the area, the greater the tape tension Fr and the greater the coefficient of friction between tape 8 and the substrate 1*a*. In addition, the pressing action produces a force which rapidly carries away to the side the gas being produced.

Figure 5:
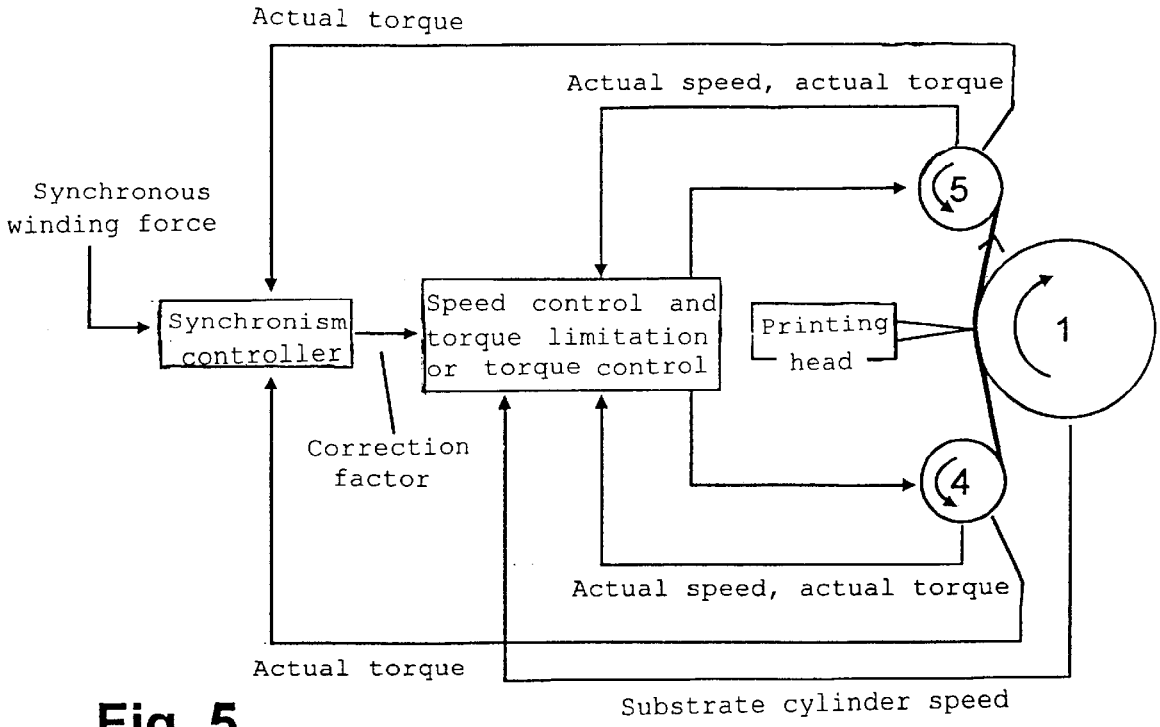
FIG. 5 shows a block diagram of a first method of controlling synchronous running.
Figure 6:
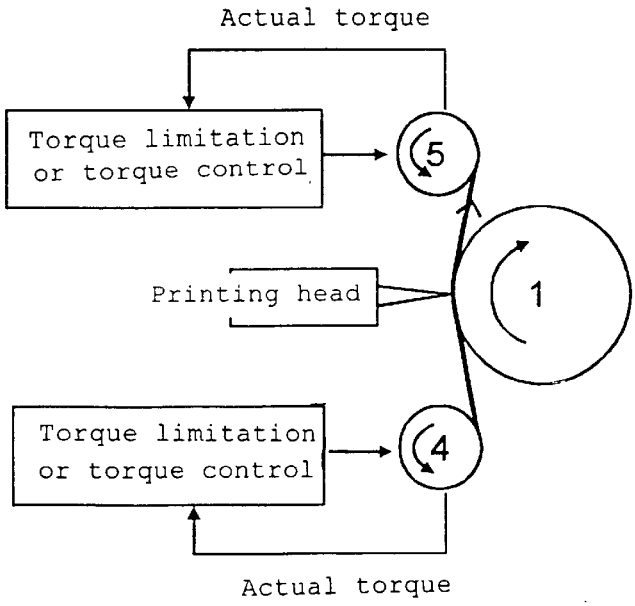
FIG. 6 shows a block diagram of a second method of controlling synchronous running.
Figure 7:
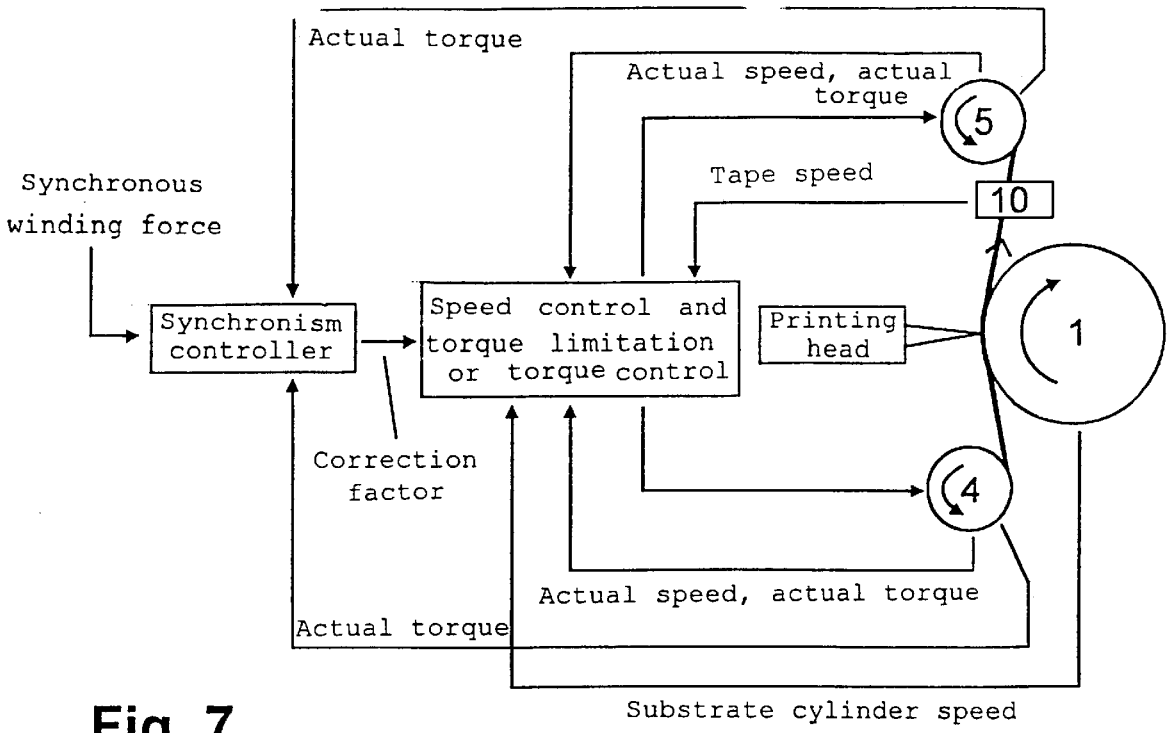
FIG. 7 shows a block diagram of a third method of controlling synchronous running, with direct measurement of the tape speed.
Figure 8:
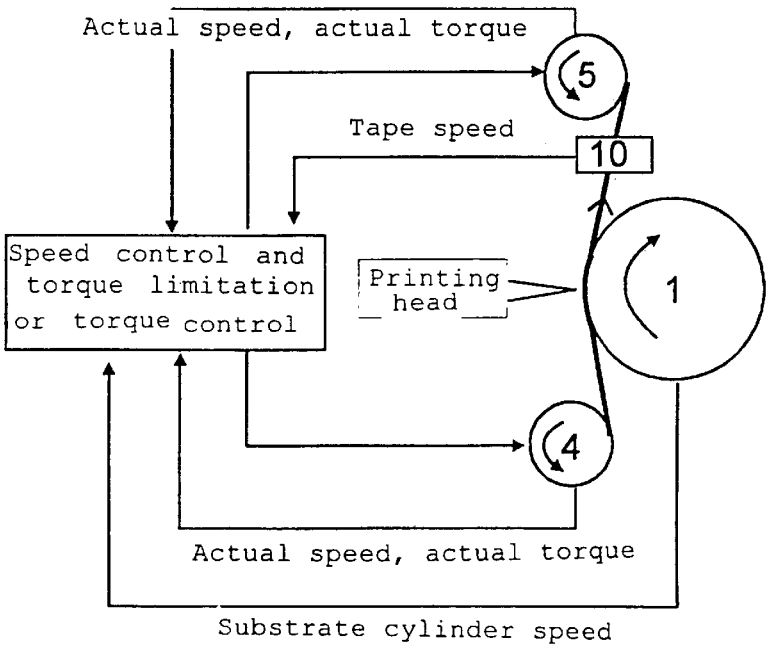
FIG. 8 shows a block diagram of a fourth method of controlling synchronous running, with direct measurement of the tape speed.

FIG. 5 shows a first control algorithm as a block diagram. The open-loop and closed-loop control schemes illustrated in this and the following FIGS. 6, 7, 8 are organized on the basis of functional units, which may be implemented such that they are not strictly separated but are likewise integrated in software or hardware.

The open-loop and closed-loop control scheme illustrated in FIG. 5 is operated in the following way:

While the transfer tape 8 is being wound round, the rewinding drive 5*a* is operated under speed control with torque limitation, and the unwinding drive 4*a* is operated under torque control or speed control within the torque limit. The thermal transfer tape 8 is then wound at a predefined desired speed and a predefined tape tension. The imaging operation takes place while the tape is being wound.

The desired speed and the tape tension are predefined in a virtual manner, the actual predefined variables being the speeds and torques for the motors 4*a*, 5*a*. The speed is given by the motor speed and the instantaneous coil diameter, and the tape tension applied is given by the motor torque and the instantaneous coil diameter.

The coil diameter varies with time, depending on the tape unwound or rewound. In order to determine this instantaneous coil diameter, it is necessary to know, for example, the core diameter, the coil diameter of the complete, non-unwound unwinding coil in the initial position and the thermal transfer tape thickness (carrier plus coating). Some of these variables may be replaced by equivalents, for example the tape thickness or the initial diameter of the full coil may be replaced by the tape length or by the knowledge of the rate at which the speed ratio between the winding drives rises, or variables derived from these.

Three methods of determining the tape length are described below.

a) The tape length may be determined by computation from the instantaneous speed ratio, the tape thickness and the instantaneous change in the speed ratio. Since the speed ratio is always a noisy measured variable, the calculated variable is subject to uncertainties. An approximate value may be determined by using a digital filter.

b) The tape length may be calculated from the instantaneous speed ratio between the rewinding and the unwinding drive, the tape speed, measured with an additional speed pick-up, and the known distance between the winding spools. Since this computed value based on measured values is noisy, a time-invariant value may be determined with the aid of a digital filter.

c) If the entire length of the tape is located on the unwind, and only one end of the tape is fastened to the rewind, the tape length may be calculated, by rotating the rewind a few turns, from the speed ratio which is measured in the process between the rewinding and the unwinding drives, as well as the known core diameter of the rewind.

In a further operating variant, the thermal transfer tape is wound at a predefined desired speed and with a predefined tension from the unwinding drive on the basis of the knowledge of geometrical variables relating to the tape station and to the speed ratio between the drives, without the aid of a tape speed measuring device. The desired tape speed is set equal to the calculated, measured or predefined surface speed of the substrate 1*a*. The difference between the desired synchronous winding force and the measured actual winding force can be used by a control algorithm (synchronism controller) to readjust the desired tape speed or else the desired speed of the rewind drive, in order to operate with synchronous running and to keep the passage speed of the transfer tape at the synchronous speed. In order to avoid the stick—slip effect, the tensile force applied to the transfer tape by the drives and further measures must be smaller than the sum of the synchronous winding force and the adhesive force of the transfer tape on the printing-form surface. Furthermore, the transient response of the control loop is shortened in this way.

FIG. 6 shows a second control algorithm as a block diagram. While the transfer tape is being wound, both the rewinding drive and the unwinding drive arc operated under torque control or speed control within the torque limit. The two above-mentioned control forms of the drives can be used in a mixed fashion. As described above, the drives are able to exert a predefinable tensile force on the thermal transfer tape 8 when they are in this operating mode. The tensile force of the rewinding drive 5 may be selected to be equal to or slightly greater than the synchronous winding force. The tape speed is determined by the action of the transfer tape rolling on the substrate cylinder, and is equal to the substrate surface speed. In order to avoid the stick—slip effect, the tensile force applied to the transfer tape by the drives and further measures must be smaller than the sum of the synchronous winding force and the adhesion force of the transfer tape on the printing-form surface. Suitable selection of the control parameters for the winding drives means that they can be given a compliant behavior, so that this requirement is more easily met.

FIG. 7 shows a third control algorithm as a block diagram. The tape speed is measured directly by a separate measuring device 10, for example by means of a corotating roll, and the speed and the torque of the guides 4, 5 are readjusted in such a way that the tape speed is approximately equal to the calculated, measured or predefined surface speed of the substrate cylinder 1. Since the measurement of the tape speed is subject to inaccuracies and noise, the difference between the desired synchronous winding force and the measured actual winding force can be used by a control algorithm to readjust the desired tape speed or the desired speed of the rewind drive, in order to operate with synchronous running. For the synchronous running state, the control process has to operate sufficiently accurately that any relative speeds are compensated for by the expansion of the transfer tape. In order to avoid the stick—slip effect, the tensile force applied to the transfer tape by the drives and further measures must be smaller than the sum of the synchronous winding force and adhesion force of the transfer tape on the printing form surface.

FIG. 8 shows a fourth control algorithm as a block diagram. The tape speed is measured directly using a separate measuring device (10), for example by means of a corotating roll, and the speed and the torque of the drives (4, 5) are readjusted in such a way that the tape speed is approximately equal to the calculated, measured or predefined surface speed of the printing form (1)

Any relative speeds between the passage speed of the thermal transfer tape and the surface speed of the printing-form cylinder must be so small that they can be compensated for by the expansion of the transfer tape. The tensile force applied to the transfer tape by the drives and further measures must be smaller than the sum of the synchronous winding force and the adhesive force of the transfer tape on the printing-form surface, in order to avoid the stick—slip effect.

In all the winding modes, the functions of the drives can be exchanged for one another, so that both tape transport and thus synchronous running are possible in both directions. In this case, the rewind drive takes over the function of the unwind and the unwind drive takes over the function of the rewind.

The control structures which are used can be expanded by learning systems which, using the observed system behavior, adapt the control parameters or control structure in order to optimize the quality of control and thus the synchronous running.

The speeds of the drives may also be determined without a speed pick-up. Speeds can also be calculated from the drive variables which are available, for example rotary encoder pulses per unit time.

In every case, a control algorithm readjusts the desired values for the drive control in such a way that the predefined desired values are maintained.

Figure 4:
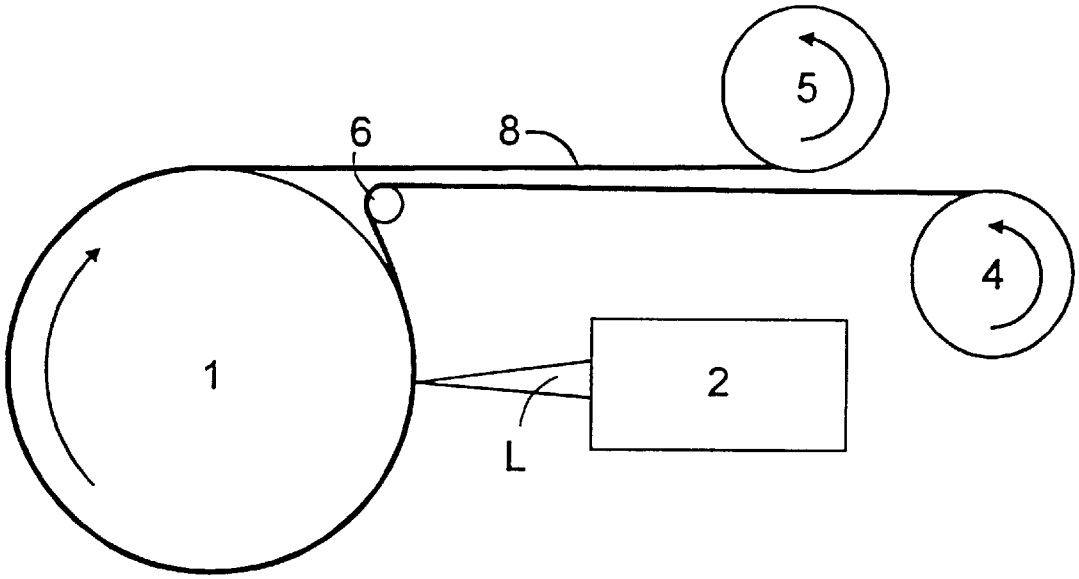
FIG. 4 shows a side view of a thermal transfer apparatus for implementing the method according to the invention, with a third tape guiding means.

In an arrangement which develops the invention further, in particular in the case of a seamless substrate sleeve, in order to increase the overall frictional force, the wrap angle of the transfer tape 8 may be increased until it wraps almost completely around the substrate cylinder 1, as illustrated in FIG. 4.

Another embodiment is described in FIG. 3. At least one of the contact rolls 6*a* is pressed with a defined pressure against the substrate cylinder 1. This roll is preferably equipped with a soft, that is to say compressible, surface. By this means, a positive frictional force may be produced via the contact pressure.

In further embodiments of FIGS. 1 and 2 which develop the invention further, the contact force is increased, in particular also in the region of the imaging operation, and thus the distance between the band and the substrate surface is additionally reduced. This can be carried out within the context of FIGS. 1 and 2 by increasing the tension on the transfer film 8, this tension being applied in the longitudinal direction of the transverse film by the motors, by the rewind motor 5*a* applying an increased pulling torque and the supply-coil motor 4*a* applying a braking torque in the opposite direction. The braking torque may be assisted by passive braking devices. However, increasing the tape tension is limited by the breaking tension of the transfer tape and the power of the rewind motor 5*a*.

Figure 9:
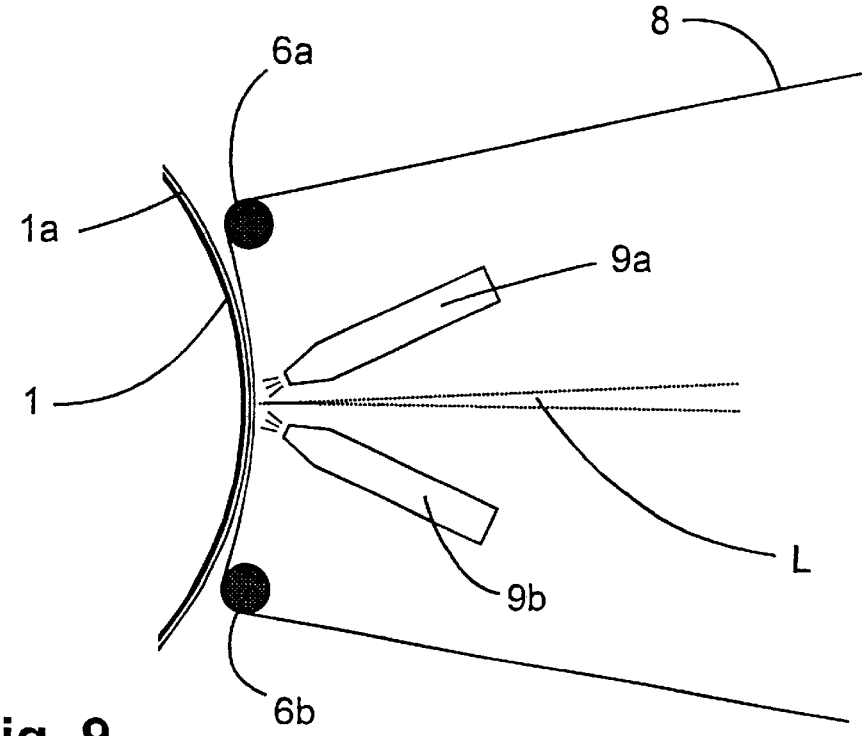
FIG. 9 shows a side view of a first arrangement for using air nozzles to press on the transfer tape by means of air jets.

A development which works together with and assists the above without problems is illustrated in FIG. 9. The contact force between the transfer film and printing cylinder is increased by compressed air being blown onto the transfer film on the side facing away from the printing cylinder.

The preferred arrangement uses a combination of a nozzle which acts at a point at the location where the laser acts, acting directly on the plasma zone, that is to say the location at which the gas is produced, and one or more nozzles which presses or press on the transfer film over its entire width.

In order to use the nozzles which act over an area and which press on the transfer film over its entire width, the active zone of the compressed air must not reach beyond the edge of the transfer tape, since otherwise the transfer film would be lifted at its edge region by the flowing air impinging on the printing-cylinder surface.

If use is made of a tape arrangement in which a number of imaging tracks can be written alongside one another, the nozzle for the point-like blowing action must be kept stationary in relation to the laser imaging head, that is to say must always act on the point of impingement of the laser beam or beams on the transfer tape, while the nozzles which act over an area must remain stationary in relation to the tape, that is to say the tape must be shifted sideways in relation to the imaging head.

The nozzles used for blowing over an area may be designed in various forms: nozzles with one or more point openings, flat nozzles comparable with the design of air bearings, and slot-like nozzles. In the case of slot-like nozzles or nozzles which comprise a number of small openings in a row and which press on the transfer film over its entire width, a distinction is drawn between nozzles which are aligned parallel to the axis of the printing cylinder and nozzles which are inclined by a specific angle with respect to the axis of the printing cylinder, by which means the air flowing out of the gap between the transfer film and printing cylinder has a preferred direction impressed on it, and the outward flow is promoted.

As an alternative to this, use may be made of a flat nozzle which is located over the laser action zone, it being necessary for this nozzle to consist, at the beam penetration area, of a material which is transparent to the laser wavelength used. Nozzles which act in the region between the first point of contact between the first transfer film and the printing cylinder and the location at which the laser acts on the transfer film lead to the transfer film making uniform contact and to a reduction in the quantity of air between the transfer film and the printing cylinder as a result of an increased outward flow of the air into the surrounding area, in particular when nozzles are used which act over the entire width of the tape.

All types of nozzles which act in the area of the laser action zone primarily lead to a reduction in the distance between the transfer film and the printing cylinder, by compressing the remaining air and the gases produced by the transfer process. It is of course possible for the nozzles to be used in any desired suitable combination for both regions, area and point-like, in particular including one type of nozzle and nozzles which act over an area or only at a point.

Figure 10:
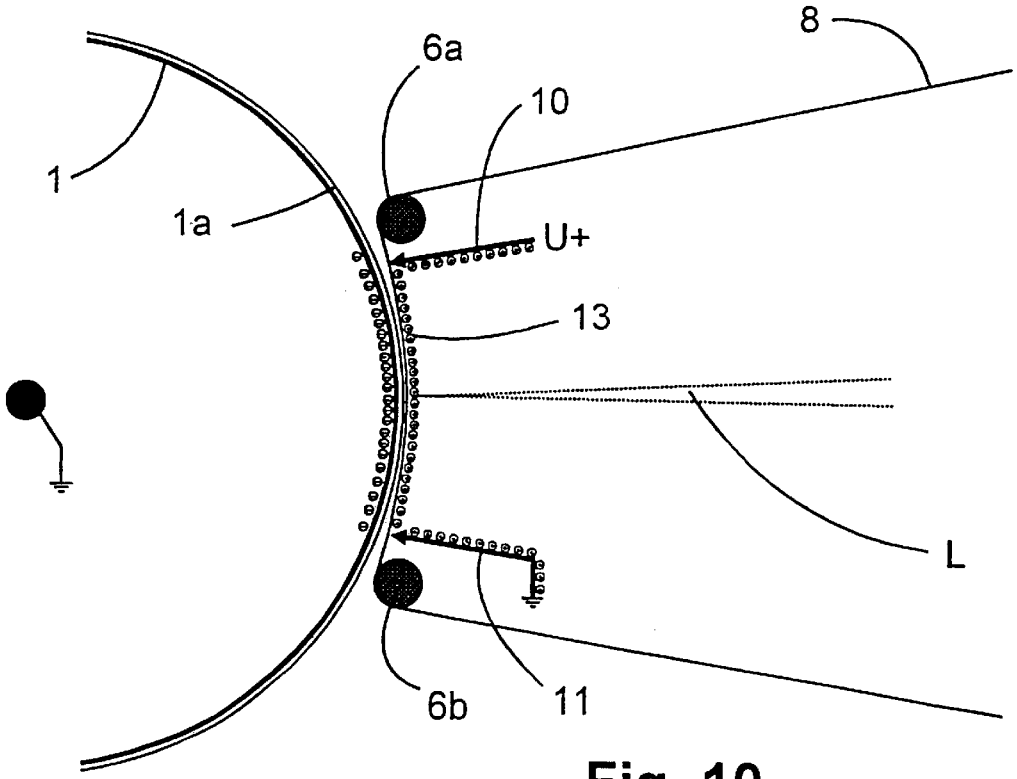
FIG. 10 shows a side view of an arrangement for using electrostatic charge to increase the contact force between tape and substrate.

A further development of FIGS. 1 and 2 is illustrated in FIG. 10. The increase in the contact pressure is produced here by electrostatic charge. A brush 10 applies charge 13 to the carrier side of the tape, that is to say the side facing away from the substrate 1*a*. In this case, the substrate cylinder 1 is conductive and grounded. By means of induction, charges of the opposite polarity are formed under the substrate surface 1*a* and form a type of plate cylinder with a resulting electrostatic force. The charge applied is then picked off again, by means of a grounded brush 11, following the passage through the imaging and contact zone, before the transfer tape 8 is wound up again.

Of course, negative charges may be applied instead of the positive ones shown, and charges can, of course, also be applied by devices other than brushes, for example via a corona discharge. Furthermore, the deflection rolls 6*a* and 6*b* may also and elegantly serve as charging and discharging electrodes, respectively, as may other rolls which are fitted further away, such as the rolls 7*a* and 7*b* in FIG. 1. In the latter case, attention must be paid to adequate electrical insulation of the rolls 6*a* and 6*b*.

Furthermore, contact rolls, as in FIG. 3, or pressure brushes may be used to increase the contact force, it being possible for these devices to be used only in the region between the first point of contact between the transfer film and the printing cylinder and the zone of action of the laser beam, since the laser beam must not be disadvantageously impaired by these elements. These devices primarily produce the increased outward flow of the air from the gap between the transfer film and the printing cylinders to the surrounding area; reducing the distance by compressing the aid plays a subordinate role here.

In addition to the possibility of compressing the air dragged in between the transfer film and the printing cylinder and forcing it to flow out laterally, and in this way of reducing the distance between the transfer film and the printing cylinder, it is also possible for the quantity of air which is dragged in between the transfer tape and the printing cylinder to be reduced.

On the one hand, this is achieved just by synchronous running. If this is the case, the majority of the air layers adhering to the surfaces of the transfer film and the printing cylinder is expelled to the side upstream of the first point of contact between the tape and the printing cylinder.

A further possibility for reducing the quantity of air dragged into the gap between the transfer film and the printing cylinder is to remove the air layer which adheres to the surface of the transfer tape and to the surface of the printing cylinder and is carried along with them. On the one hand, this can be achieved by a mechanical device, such as brushes, which wipe off the adhering air layer shortly before the transfer film and the printing cylinder come into contact. On the other hand, at the point at which the transfer film comes into contact with the printing cylinder, the air can be extracted by suction, by which means the air layer adhering to the surface of the transfer tape and to the surface of the printing cylinder is largely extracted at the same time. This means that the air volume which is concomitantly dragged into the gap between the transfer tape and the printing cylinder is reduced considerably and a vacuum is produced dynamically, and then produces a contact force by interaction with the static air pressure.

Finally, the methods of optimizing the thermal transfer process are summarized once more:

During the production of an offset printing form by means of laser—induced thermal transfer, a thin tape-like transfer film is brought into contact with the surface of the printing cylinder at the location of the laser action, and the transfer film is moved continuously past the printing cylinder during the imaging operation, the coated side of the thermal transfer tape facing the printing cylinder.

At the laser action location, the image information is transferred dot by dot from the tape to the printing surface, it being necessary for the material detached to travel over the distance between the transfer film and the printing surface.

It has transpired that the transfer of the thermal transfer material from the carrier film to the printing surface is better, the shorter the distance between the carrier film and the printing cylinder. In addition, the quality of the transfer also increases as a result of the distance between the transfer film and the printing surface being uniform throughout the entire imaging operation. If the distance between the transfer film and the printing cylinder is too great, the material is transferred only incompletely and very indistinctly from the transfer tape to the printing cylinder.

The distance between the transfer tape and the printing cylinder is caused by air which is dragged into the gap between the transfer tape and the printing cylinder in the region of the zone of action of the laser, on the surface of the printing cylinder and on the surface of the transfer tape. At the laser action location, the distance between the transfer film and the printing cylinder is increased still further by the laser-induced, brief, severe local heating, since the air which is located in the gaps between the transfer film and printing cylinder expands because of the temperature rise and, during the short time over which the heating takes place, cannot escape completely into the surrounding area laterally through the gap between the transfer film and the printing cylinder, and thus lifts the tape still further from the printing-form surface. In addition, on the laser action zone, not only is the thermal transfer material which is on the transfer film melted, but some of the material is also converted into gaseous constituents which, as already described, also lead to an increase in the distance.

The following text describes measures which contribute to reducing the distance between the transfer film and the printing cylinder and thus to increasing the quality of the transfer process.

1) By increasing the normal force with which the tape is pressed perpendicular to the printing-cylinder surface, it is possible for the distance between the tape and cylinder to be reduced, since the air is more intensively compressed by the increased action of force and, as a result, occupies a smaller volume. In addition, the outward flow of air from the gap between the transfer film and the printing—cylinder surface is promoted because of a pressure drop which results from the gap towards the surrounding area. As a result, the quantity of air which is located in the gap between the transfer film and the printing cylinder is reduced, which reduces the distance between the two above-mentioned elements.

1.1 Increasing the tensile stress which is applied to the transfer film in its longitudinal direction increases the normal force, in relation to the area element, between the transfer film and the printing cylinder in the area of contact between the transfer film and the printing cylinder; the contact area may extend from small wrap angles of about 5° up to complete wrapping.

Increasing the tape tension is achieved by:

- increasing the opposing torque of the unwinding motor;
- additional devices which brake the unwinding motor, such as braking devices which are based on friction (disc, block, fluid or drum brakes), or else non-contacting brakes such as electromagnetic brakes; and
- devices which brake the transfer tape, such as clamping devices, braked pressure rolls, and holding rolls.

1.2 By charging the transfer film electrostatically, the normal force between the transfer film and the printing cylinder is likewise increased, which brings about the effect described above. The charging of the transfer film is carried out upstream of the contact point between the transfer film and printing cylinder, and the charge is applied to that side of the transfer film facing away from the printing surface. The printing cylinder may be charged equally and oppositely to the transfer film in order to increase the force effect further.

1.3 The use of contact rolls or pressure brushes likewise leads to an increase in the normal force, it being possible for these devices to be used only in the region between the first point of contact between the transfer film and the printing cylinder and the zone of action of the laser beam, since the laser beam must not be disadvantageously impaired by these elements. These devices primarily effect an increased outward flow of the air from the gap between the transfer film and the printing cylinder to the surrounding area. Reducing the distance by compressing the air plays a subordinate role here.

1.4 Increasing the normal force between the transfer film and the printing cylinder by blowing compressed air on the transfer film on the side facing away from the printing cylinder. The nozzles used to blow on the tape may be designed in various forms (nozzles with one or more point openings, flat nozzles comparable with the design of air bearings, slot-like nozzles).

Furthermore, a distinction must be drawn between nozzles which press the transfer film against the printing cylinder over the entire width of the film, and nozzles which press the transfer film against the printing cylinder only at a point.

In the case of both slot-like nozzles or nozzles which comprise a number of small openings in a row, which press the transfer film over its entire width, a distinction is drawn between nozzles which are aligned parallel to the axis of the printing cylinder and nozzles which are inclined at a specific angle to the axis of the printing cylinder, as a result of which the air flowing out of the gap between the transfer film and printing cylinder has a preferred direction impressed on it, and the outward flow is promoted.

If use is made of nozzles which press on the transfer film over its entire width, the zone of action of the compressed air must not reach beyond the edge of the transfer tape, since the transfer film would otherwise be lifted in its edge region by the flowing air impinging on the surface of the printing cylinder.

Nozzles which act at a point are used in particular to act on the laser action zone, since at this point, as described above, the distance is increased still further because of the transfer process, combined with the formation of a plasma at the laser action point.

At the laser action point, it proves to be particularly beneficial to use both a point-like nozzle which acts directly on the plasma zone and a nozzle which presses on the transfer film over the entire width of the film.

As an alternative to this, use may be made of a flat nozzle which is located over the laser action zone, it being necessary for this nozzle to consist of a material through which the laser beam passes and which does not have a detrimental influence on the beam.

In summary, the following conclusion may be drawn:

Nozzles which act in the area between the first point of contact between the transfer film and the printing cylinder and the laser action point on the transfer film lead to the transfer film making uniform contact and to a reduction in the quantity of air between the transfer film and the printing cylinder, as a result of an increased outward flow of the air into the surrounding area, in particular if nozzles arc used which act over the entire width of the tape.

All types of nozzles which act in the area of the laser action zone primarily lead to a reduction in the distance between the transfer film and the printing cylinder, as a result of compression of the remaining air and the gases produced by the transfer process.

For both regions, the nozzles may be used in any desired combination.

2) In addition to the possibility of compressing the air dragged in between the transfer film and the printing cylinder and of forcing it to flow out laterally, and in this way reducing the distance between the transfer film and printing cylinder, the quantity of air which is dragged in between the transfer tape and the printing cylinder can also be reduced.

2.1 This is achieved by the transfer film being moved synchronously with the printing cylinder at a relative speed which is only low, zero in the ideal case, that is to say with identical surface speeds. If this is the case, the majority of the air layers adhering to the surfaces of the transfer film and the printing cylinder is expelled to the side upstream of the first point of contact between the tape and the printing cylinder.

At higher relative speeds, a fluid boundary layer is formed between the two surfaces (aerodynamic effect) comparable with the effects in hydrodynamic sliding bearings, in which, as the relative speed rises, a fluid boundary layer is formed between the two elements which move in relation to each other.

2.2 A further possibility for reducing the quantity of air dragged into the gap between the transfer film and the printing cylinder is to remove the air layer which adheres to the surface of the transfer tape and to the surface of the printing cylinder and is moved along with them.

On the one hand, this can be achieved by means of a mechanical device such as brushes which wipe off the adhering air layer shortly before the transfer film and the printing cylinder come into contact.

A further possibility is to extract air by suction at the point at which the transfer film comes into contact with the printing cylinder, by which means the air layer adhering to the surface of the transfer tape and to the surface of the printing cylinder is also largely extracted at the same time. This means that the air volume which is dragged concomitantly into the gap between the transfer tape and printing cylinder is reduced considerably.

Measures to use the above-mentioned methods as well in the case of a tape station which can be shifted sideways in the axial direction of the cylinder in relation to the laser printing head are also contemplated.

Shifting the transfer film sideways permits the transfer film to be utilized better and the frequency of changing the transfer film to be reduced. The aim is to achieve equally good quality of transfer, irrespective of the position of the transfer film in relation to the laser action point. The laser action point is always located on the transfer film (that is to say the transfer film is shifted in the axial direction of the cylinder in relation to the laser action point by a maximum of the width of the transfer film).

In order to achieve this, all the devices which contribute to reducing the distance between the transfer film and the printing cylinder and act over the entire width of the tape have to be shifted in the axial direction of the printing cylinder in the same way as the transfer tape and with it. This applies in particular to all the nozzle devices which act over the entire width of the transfer film (cf. description above). In summary, this means that none of these devices may move in relation to the transfer film when the latter is shifted in the axial direction of the cylinder.

On the other hand, point nozzles which act only on the laser action point, that is to say on the plasma zone, must not be shifted in relation to the laser beam, in order to ensure that the point nozzle always acts on the laser action zone.

If the laser printing head rather than the transfer tape is shifted in the axial direction of the printing cylinder in relation to the tape, it is likewise true that the point nozzle must not be shifted in relation to the laser beam, and none of the devices which act over the entire width of the transfer film may be shifted in relation to the transfer tape.

The invention is not limited by the embodiments described above which are presented as examples only but can be modified in various ways within the scope of protection defined by the appended patent claims.

We claim:

1. A method of producing a thermal transfer print on a substrate cylinder using a tape transfer film, comprising the steps of:

exerting a contact force on a substrate using the transfer film for producing a static friction force; and controlling synchronism between the tape transfer film and the substrate cylinder by using the static friction force.

2. A method according to claim 1, wherein the contact force exerting step includes producing the contact force by tape tension in conjunction with the tape transfer film wrapping around the substrate cylinder at a wrap angle sufficient to generate a friction force between the transfer film and the substrate.

3. A method according to claim 1, wherein the controlling step is carried out actively by determining a speed difference between the transfer film and the substrate cylinder and adjusting transfer film speed based on the speed difference.

4. A method according to claim 1, wherein the controlling step is carried out passively by setting speed of the transfer film to a predefined valve whereby a difference between the transfer film speed and speed of the substrate cylinder is compensated for by plastic expansion of the transfer film.

5. A method according to claim 1, wherein the contact force exerting step includes blowing on the transfer film to form a force component of the contact force.

6. A method according to claim 1, wherein the contact force exerting step includes applying charge to a back of the film to form electrostatic forces which form a force component of the contact force.

7. A method according to claim 1, and further comprising the step of extracting air in an entry gap between the film and the substrate so as to create a vacuum that assists the contact force.

* * * * *